US009366252B2

(12) United States Patent
Holtmann et al.

(10) Patent No.: US 9,366,252 B2
(45) Date of Patent: Jun. 14, 2016

(54) PUMP HAVING A COLD STARTING DEVICE

(71) Applicant: MAGNA POWERTRAIN BAD HOMBURG GMBH, Bad Homburg (DE)

(72) Inventors: Ludger Holtmann, Hohenlinden (DE); Kerstin Rosenkranz, Oberursel (DE)

(73) Assignee: Magna Powertrain Bad Homburg GmbH, Bad Homburg (DE)

( * ) Notice: Subject to any disclaimer, the term of this patent is extended or adjusted under 35 U.S.C. 154(b) by 51 days.

(21) Appl. No.: 14/325,856

(22) Filed: Jul. 8, 2014

(65) Prior Publication Data

US 2015/0010419 A1 Jan. 8, 2015

(30) Foreign Application Priority Data

Jul. 8, 2013 (DE) ..... 10 2013 107 176

(51) Int. Cl.

| | |
|---|---|
| ***F04C 2/00*** | (2006.01) |
| ***F04C 15/00*** | (2006.01) |
| ***F04C 27/00*** | (2006.01) |
| ***F04C 14/06*** | (2006.01) |
| ***F04C 18/344*** | (2006.01) |
| ***F04C 2/30*** | (2006.01) |
| ***F04C 2/344*** | (2006.01) |

(52) U.S. Cl.

CPC . *F04C 14/06* (2013.01); *F04C 2/30* (2013.01); *F04C 2/344* (2013.01); *F04C 15/0023* (2013.01); *F04C 18/344* (2013.01); *F04C 2270/701* (2013.01)

(58) Field of Classification Search

CPC ..... F04C 2/344; F04C 2/30; F04C 14/06; F04C 15/0023; F04C 18/344; F04C 2270/701

USPC ..... 418/135, 131, 133, 259, 266–268, 269

See application file for complete search history.

(56) References Cited

U.S. PATENT DOCUMENTS 4,386,891 A * 6/1983 Riefel ..... F01C 21/0863 418/269
4,505,655 A * 3/1985 Honaga ..... F04C 15/0023 418/135

(Continued)

FOREIGN PATENT DOCUMENTS

CN 102089522 A 6/2011
CN 102400914 A 4/2012

(Continued)

OTHER PUBLICATIONS

Search Report dated Dec. 11, 2015 from corresponding Chinese Patent Application No. 2014103228202.

*Primary Examiner* — Theresa Trieu

(74) *Attorney, Agent, or Firm* — Dickinson Wright PLLC

(57) ABSTRACT

A pump has a suction region, a pressure region, and a pressure space which has an outflow region. A rotor is connected to a shaft in which rotor delivery elements are displacably received. The rotor has expelling regions connected to the pressure region by way of a first fluid path. A cold starting device is prestressed into a first functional position to shutoff a second fluid path from the pressure region to the pressure space, and is configured to be displaced counter to the prestress into a second functional position to open the second fluid path. The cold starting device is arranged in its second functional position at least in regions with a relief face which faces away from the pressure region in a relief receptacle. The relief face is loaded during operation of the pump with a pressure being smaller than a system pressure in the outflow region.

20 Claims, 5 Drawing Sheets

(56) References Cited

U.S. PATENT DOCUMENTS

Figure 1:
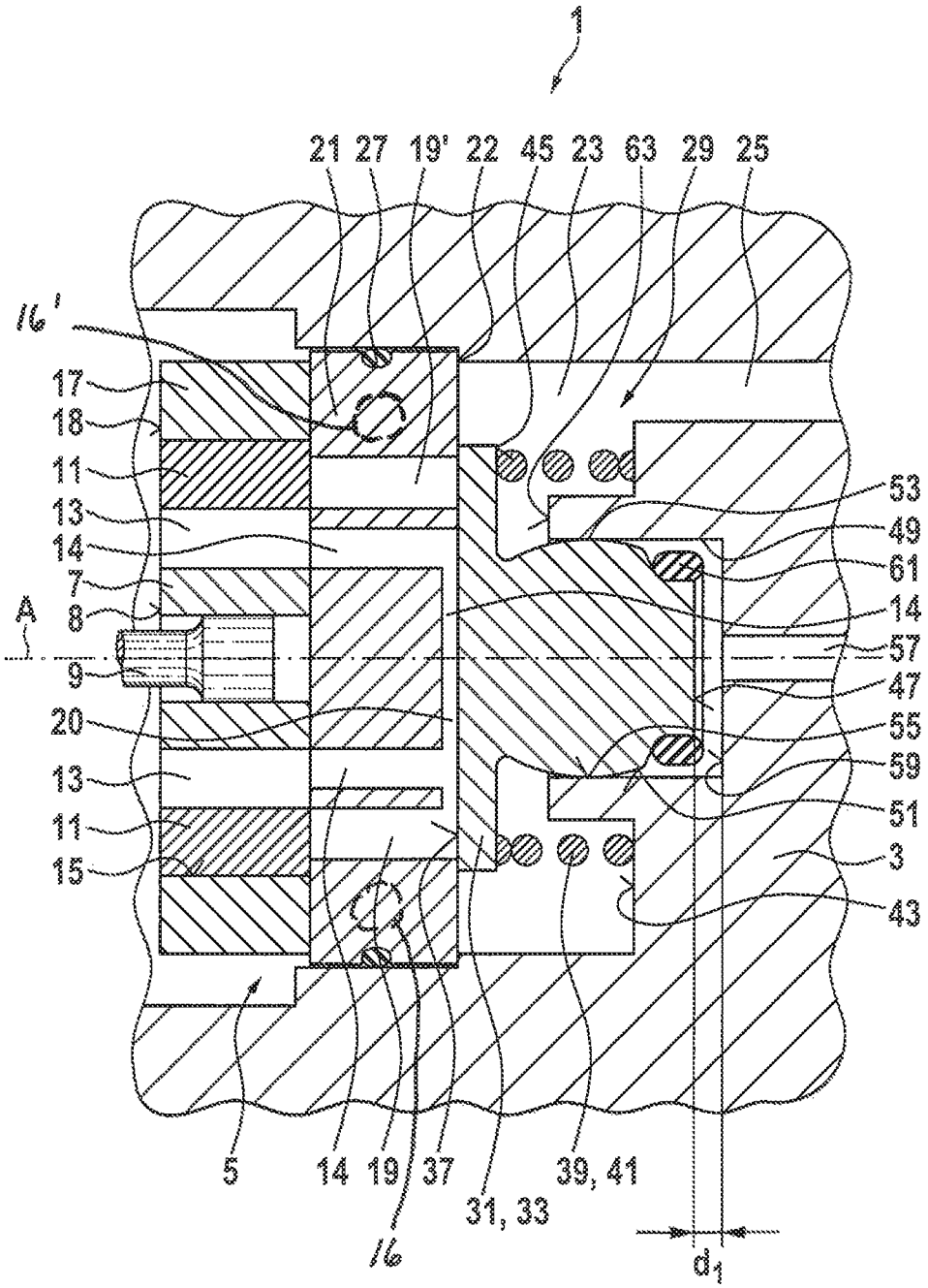

| | | | | |
|---|---|---|---|---|
| 5,807,090 | A * | 9/1998 | Agner | F04C 15/0023 418/135 |
| 2011/0211984 | A1* | 9/2011 | Zinke | F04C 15/0023 418/135 |
| 2011/0211985 | A1* | 9/2011 | Dippel | F04C 15/0023 418/135 |

FOREIGN PATENT DOCUMENTS

| | | | |
|---|---|---|---|
| DE | 3212363 | A1 | 2/1983 |
| DE | 19631846 | A1 | 2/1997 |
| EP | 0758716 | A2 | 2/1997 |
| JP | H09119383 | A | 5/1997 |

* cited by examiner

PUMP HAVING A COLD STARTING DEVICE

RELATED APPLICATION

The subject application claims priority to German Application No. DE 102013107176.7, filed on Jul. 8, 2013, and entitled a "Pump", the entire disclosure of which is incorporated herein by reference.

FIELD

The present disclosure relates to a pump having at least one suction region and at least one pressure region and, more particularly, to pumps having a cold starting device.

BACKGROUND

This section provides background information related to the present disclosure that is not necessarily prior art.

A pump which has two pump sections with each pump section having one suction region and one pressure region is apparent from European Patent Application EP 0 758 716 A2. A pressure space with an outflow region to a consumer is provided, the pump delivering, during its operation, a fluid from the suction regions into the pressure space and via the outflow region further to a consumer. The pump has a rotor which is operatively connected to a shaft which can be rotated about a rotational axis. Delivery elements are received displaceably, as viewed in the radial direction, in the rotor, the delivery elements being configured as vanes, with the result that the known pump overall is configured as a vane cell pump. The function of the pump is configured in such a way that the rotor rotates within a contour ring during operation, driven by the shaft, two crescent-shaped delivery spaces being formed by it which are passed through by the delivery elements which can be displaced in the radial direction. This results during the rotation of the rotor in spaces which become larger and smaller, namely the suction and pressure regions. Radially within the delivery elements, the rotor has expelling regions which are connected at least partially to at least one pressure region via a first fluid path. In the vane cell pump, for example, lower vane grooves are provided by way of which the expelling regions are fluidically connected to at least one pressure region, in order to expel the vanes during starting of the pump. During operation of the pump, the delivery elements are driven radially to the outside not only by way of the centrifugal forces which act on account of the rotor rotation, but also assisted by the pump pressure which prevails in the expelling regions via the first fluid path, with the result that they run sealingly on an inner circumferential face of the contour ring. The pump is typically arranged in such a way that its rotational axis extends substantially in the horizontal direction. If the pump is brought to a standstill in a warm operational state, the delivery elements which lie at the top slide into their receptacles which are provided on the rotor on account of gravity, as a result of which the separation which otherwise exists between the suction and pressure region as a result of the delivery elements is dispensed with. This produces as it were a short-circuit in the pump section which lies at the top. The delivery elements which lie at the bottom remain in contact with the contour ring as a result of gravity, with the result that the suction and the delivery region are separated here by way of the extended delivery elements.

If the fluid which is delivered by the pump, for example a hydraulic oil, now gets colder, its viscosity increases with the result that the mobility of the delivery elements decreases. If the pump is started up, at any rate a greatly reduced delivery capacity is produced in the case of cold starting on account of the short-circuit in one pump section. In order to avoid this problem, a cold starting device is provided in the pump disclosed in European Patent Application EP 0 758 716 A2, which cold starting device comprises a cold starting element which is prestressed into a first functional position, in the form of a cold starting plate. In its first functional position, the cold starting element shuts off a second fluid path which leads from the pressure regions to the pressure space. At the same time, a fluidic connection between the two pressure regions of the two pump sections is preferably also shut off by way of the cold starting element. In a second functional position, the cold starting element releases the second fluid path. Here, the cold starting element is configured and arranged in such a way that it can be displaced counter to the prestress into its second functional position by way of a pump pressure which is generated in the pressure regions during operation of the pump. In the first functional position, there is no fluidic connection between the pressure regions and the pressure space with the result that the fluid which is delivered by the pump when running up is delivered completely via the first fluid path into the expelling regions. In this way, the delivery elements are displaced out of their receptacles in the rotor with the result that the short-circuit which exists at a standstill between the suction and the pressure region is closed. The first fluid path is particularly preferably configured in such a way that it supplies expelling regions of this type with fluid, which expelling regions are just moving through a suction region, as viewed in relation to the rotation of the rotor. Therefore, during cold starting, the pump rapidly reaches its complete delivery capacity. If the pump pressure in the pressure regions exceeds the prestressing force which holds the cold starting element in its first functional position, the cold starting element is displaced counter to the prestress into its second functional position with the result that it then also releases the second fluid path which leads from the pressure regions to the pressure space. Therefore, in the case of sufficient pump pressure, fluid is then also delivered through the pressure space and via the outflow region to the consumer.

It is disadvantageous here that, during the operation of the pump, the cold starting element is constantly loaded on a side which faces away from the pressure regions with a system pressure which prevails in the outflow region. Two force components which are added together therefore act on the cold starting element in the direction of the first functional position, namely firstly the prestressing force and secondly the force which acts on account of the system pressure which prevails in the outflow region. These forces have to be balanced by the pump pressure during operation of the pump in order to hold the cold starting element permanently in its second functional position. The pump pressure in the at least one pressure region therefore always has to be greater by an amount which corresponds to the prestressing force than the system pressure which prevails in the outflow region. This additional pressure difference has to be applied permanently by the pump, as a result of which said pump has an increased power consumption.

SUMMARY

This section provides a general summary of the disclosure, and is not a comprehensive disclosure of its full scope or all of its features, aspects or objectives.

The disclosure is based on the object of providing a pump which does not have the stated disadvantage. In particular, a power consumption of the pump is to be reduced with an identical delivery capacity, it being intended for the solution to be configured so as to save installation space and to be inexpensive.

The object is achieved by a pump having at least one suction region and at least one pressure region, a pressure space which has an outflow region to a consumer, a rotor which is operatively connected to a shaft which rotates about a rotational axis, in which rotor delivery elements are received displaceably, as viewed in the radial direction, the rotor having expelling regions radially within the delivery elements, which expelling regions are connected at least partially to the pressure region by way of a first fluid path, and having a cold starting device which comprises a cold starting element which is prestressed into a first functional position and, in its first functional position, shuts off a second fluid path from the pressure region to the pressure space, the cold starting element opening the second fluid path in a second functional position, the cold starting element being configured and arranged in such a way that it can be displaced counter to the prestress into its second functional position by way of a pump pressure which is generated in the pressure region during operation of the pump, wherein the cold starting element is arranged in its second functional position at least in regions with a relief face which faces away from the pressure region in a relief receptacle in such a way that the relief face is loaded during operation of the pump with a pressure which is smaller than a system pressure in the outflow region.

By virtue of the fact that the cold starting element is arranged in its second functional position at least in regions with a relief face which faces away from the pressure region in a relief receptacle in such a way that the relief face is loaded during operation of the pump with a pressure which is smaller than the system pressure in the outflow region, the force which displaces the cold starting element overall into its first functional position is reduced considerably. The cold starting element is therefore pressure-relieved in regions, as a result of which, during operation of the pump, lower forces and consequently a lower pressure difference between the pump pressure and the system pressure are necessary in order to hold it open permanently in its second functional position. In particular, this solution provides that the complete face of the cold starting element, which face faces away from the pressure region, is no longer loaded with the system pressure but rather that the face is relieved in regions, by at any rate the relief face being loaded with a lower pressure. The lower pressure particularly preferably corresponds to an ambient pressure of the pump, in particular an atmospheric pressure which prevails in the surrounding area of the pump. The relief face and the relief receptacle can be provided in the pump in a space-saving and inexpensive manner. As a result of the pressure relief, as has already been mentioned, the difference is reduced between firstly the pump pressure and secondly the system pressure with the result that the pump has a lower power consumption with the same delivery capacity.

One preferred exemplary embodiment of the pump is configured as a vane cell pump. In this case, slots are made in the circumferential wall of the rotor, which slots receive vanes displaceably, as viewed in the radial direction. When the rotor rotates during operation of the pump, the vanes extend out of the slots by a distance which is predefined depending on the rotary angle of the rotor by the contour of an inner circumferential wall of a contour ring, in which the rotor is arranged. Here, the vanes run on an inner circumferential face of the contour ring. By way of the centrifugal force firstly and the pump pressure which prevails in the expelling regions secondly, the vanes are displaced against the inner circumferential face of the contour ring.

Another exemplary embodiment of the pump is configured as a roller cell pump. Here, the delivery elements are configured as rollers which are received displaceably, as viewed in the radial direction, in corresponding shaped receptacle cutouts of the rotor. In this case, the rollers preferably run on an inner circumferential face of a contour ring, in which the rotor is arranged. The function of the roller cell pump is otherwise identical to the function of a vane cell pump, with the result that reference is made to the description of the latter.

It is possible that the pump has only one pump section which defines a pressure space and a suction space. In this case, the pressure region is preferably fluidically connected to the expelling regions which, as viewed in the circumferential direction, are arranged at the level of the suction region. This ensures that, during starting of the pump, the delivery elements in the suction region are displaced against the contour ring, with the result that the suction function of the pump is ensured from the start.

One exemplary embodiment of the pump is also preferred, in which the pump is of double-flow configuration. In this case, the pump comprises two pump sections, a first pump section having a first pressure region and a first suction region which is assigned to it, and a second pump section having a second suction region and a second pressure region which is assigned to it. Here, a fluidic connection is preferably provided from the first pressure region to expelling regions which, as viewed in the circumferential direction, are arranged at the level of the second suction region. Here, in the case of a correct installation of the pump, the first pressure region is preferably arranged so as to lie at the bottom. The fact that the second suction region which trails the first pressure region, as viewed in the rotational direction of the rotor, is supplied with fluid during starting of the pump in the expelling region which is assigned to it ensures that the second pump section which lies at the top can also produce a delivery output as it were from the start of the pump.

It is possible that a fluidic connection is provided between the second pressure region and expelling regions which, as viewed in the circumferential direction, are arranged at the level of the first suction region. As an alternative, it is preferably possible that the expelling regions at the level of the first suction region are also fluidically connected to the first pressure region, the second pressure region preferably not being fluidically connected to expelling regions in this case. In particular, the pump is preferably configured in such a way that the pump section which lies at the bottom in the case of installation as intended supplies the expelling regions of the suction region of the pump section which lies at the top with pressurized fluid, in order to drive the delivery elements which are retracted in the top pump section at a standstill into their functional position. In addition, it is possible that the first pressure region is also fluidically connected to expelling regions of the first suction region which is assigned to it. In its first functional position, the cold starting element preferably also shuts off a fluidic connection between the first and the second pressure region.

A pump is preferred which is distinguished by the fact that the cold starting element is configured as a cold starting plate. In this case, in its first functional position, the cold starting plate preferably covers at least one pressure region with the result that the latter is not in fluidic connection with the pressure space. A fluidic connection between the two pressure regions of a pump of double-flow configuration is also preferably interrupted by way of the cold starting plate when the cold starting plate is arranged in its first functional position. In one exemplary embodiment, in which only one pressure region is fluidically connected to expelling regions, it is sufficient if the cold starting plate covers the one pressure region and interrupts its connection to a second pressure region which is not fluidically connected to expelling regions.

The cold starting element, in particular the cold starting plate, is preferably prestressed into its first functional position by way of a spring element. The spring element is preferably configured as a helical spring.

It is provided in an alternative exemplary embodiment of the pump that the cold starting element comprises at least one cold starting valve insert. If the pump has two pump sections, each pump section is preferably assigned a separate cold starting valve insert. In an exemplary embodiment of this type, the relief face is preferably arranged on a piston of the cold starting valve insert, with the result that the piston is pressure-relieved.

A pump is also preferred which is distinguished by the fact that the relief receptacle is configured as a bore. The bore is preferably arranged in a housing of the pump. In this way, a compact arrangement of the relief receptacle and therefore also of the relief face which saves installation space is possible. In particular, no separate element is required as a result of the integration of the relief receptacle into the pump housing.

A pump is also preferred which is distinguished by the fact that a relief bore opens into the relief receptacle. The relief bore is fluidically connected to the surrounding region of the pump or to a reservoir for fluid which is delivered by the pump. The relief receptacle is pressure-relieved by way of the relief bore. If the relief bore is fluidically connected to the surrounding region of the pump, ambient pressure, preferably atmospheric pressure, prevails in the region of the relief bore and therefore also in the region of the relief receptacle. It is clear that the pressure, with which the relief face is loaded, is smaller in this case than the system pressure of the pump in the outflow region. As an alternative or in addition, it is provided that the relief bore is fluidically connected to a reservoir for fluid which is delivered by the pump. Here, the pump delivers the fluid from the reservoir to a consumer, from which it preferably runs back into the reservoir again. Here, with or by way of the consumer, the pump generates a pressure difference between the reservoir and the outflow region which is fluidically connected to the consumer. To this extent, there is always a pressure in the reservoir, which pressure is lower than the system pressure which is predefined by the consumer in the outflow region. The relief face is therefore also loaded in this case with the pressure which is lower during operation of the pump than the system pressure in the outflow region. The reservoir is preferably of pressureless configuration, with the result that atmospheric pressure or ambient pressure also prevails here. This is the case, in particular, when the reservoir is ventilated toward the surrounding region.

A pump is also preferred in which the relief receptacle is of cylindrical configuration. The relief receptacle is particularly preferably configured as a cylindrical bore, in particular in the housing of the pump. Here, the relief receptacle is particularly preferably of circularly cylindrical configuration, in particular is configured as a circularly cylindrical bore.

A pump is also preferred which is distinguished by the fact that the relief receptacle has an axial bottom face. Here, the term "bottom face" addresses a face which is oriented substantially perpendicularly, preferably precisely perpendicularly, with respect to the rotational axis of the pump, said face delimiting the relief receptacle, as viewed in the axial direction.

In principle, an axial direction is to be understood to mean a direction which is oriented along the rotational axis of the pump. The circumferential direction is a direction which reaches around the rotational axis concentrically. A radial direction is a direction which lies perpendicularly on the rotational axis.

The relief bore preferably opens into the bottom face. The relief face is preferably arranged in the first functional position at a first spacing and in the second functional position at a second spacing from the bottom face. Here, the second spacing is smaller than the first spacing. Accordingly, the relief face is displaced towards the bottom face when the cold starting element is displaced from its first functional position into the second functional position. In one exemplary embodiment of the pump, the relief face bears against the axial bottom face in the second functional position.

One exemplary embodiment of the pump is also preferred in which the relief receptacle has an axial end face on a wall which reaches around it. The axial end face is preferably configured as an annular face. A first sealing element is arranged on the axial end face against which first sealing element the cold starting element bears sealingly with a rear face in the second functional position. The end face is preferably oriented perpendicularly with respect to the rotational axis. Correspondingly, the rear face of the cold starting element is preferably also oriented perpendicularly with respect to the rotational axis. The first sealing element extends in the circumferential direction along the end face with the result that the rear face can bear sealingly against it in the second functional position. As a result, an internal volume of the relief receptacle which is fluidically connected to the relief bore is sealed with respect to the pressure space with the result that the system pressure acts merely on the remaining rear face, whereas the relief face which is arranged in the region of the relief receptacle is loaded with the pressure which prevails in the relief bore or the relief receptacle and is lower than the system pressure. The first sealing element is preferably configured as an O-ring. It is possible that a groove, in particular an annular groove, is made in the end face, in which groove the first sealing element is received. The first sealing element and preferably the annular groove, in which it is arranged, are preferably arranged concentrically with respect to the rotational axis of the pump.

A pump is preferred which is distinguished by the fact that the cold starting element has a relief projection on its side which faces away from the pressure region, on which relief projection the relief face is arranged. Here, the relief projection is guided displaceably in the relief receptacle. Starting from the rear face of the cold starting element, the relief projection preferably extends substantially in the direction of the rotational axis away from the pressure region into the relief receptacle. The relief face is preferably configured on the relief projection as an axial end face which faces away from the pressure region and is oriented perpendicularly with respect to the rotational axis.

In one preferred exemplary embodiment, the relief projection has a cross-sectional geometry which corresponds to the cross-sectional geometry of the relief receptacle. In one preferred exemplary embodiment, both the relief projection and the relief receptacle are of cylinder-symmetrical, in particular circularly cylindrical configuration. Other suitable designs are also possible, in which the relief projection is guided displaceably in the relief receptacle.

In this context, one exemplary embodiment of the pump is preferred in which the relief projection is guided with play in the relief receptacle. This means, in particular, that a greatest external diameter of the relief projection is at least slightly smaller than a smallest external diameter of the relief receptacle. This design has the advantage that friction forces between the wall of the relief receptacle and an outer circumferential face of the relief projection are reduced. However, the clearance fit is preferably configured in such a way that sufficient guidance of the relief projection in the relief receptacle still results, so that there is no jamming of the relief projection in the relief receptacle during the displacement of the cold starting element from the first into the second functional position or vice versa.

One exemplary embodiment of the pump is also preferred in which the relief projection is of spherical configuration. In this case, as viewed in the direction of the rotational axis, it has a varying external diameter which, starting from the rear face, increases first of all as far as a region of the greatest diameter, the relief projection decreasing in size again, starting from the region of greatest diameter, towards the relief face. By way of the region of greatest external diameter, the relief projection is centered and guided in the relief receptacle. In the case of possible tilting and/or angled positioning with respect to the rotational axis, jamming of the cold starting element during its stroke from the first into the second functional position or vice versa is prevented effectively by way of the spherical shape of the relief projection. At the same time, friction between the relief projection and the relief receptacle is reduced because there is contact merely in the region of the greatest external diameter.

One exemplary embodiment of the pump is also preferred which is distinguished by the fact that the relief face which is arranged on the relief projection is reached around by a second sealing element, with which the relief projection bears sealingly against the axial bottom face in the second functional position. The second sealing element is preferably configured as an O-ring or as a shaped seal. The numbering of the sealing elements, for example, as first and second sealing element in no way means that all the sealing elements which are mentioned here and in the following text necessarily have to be provided in each exemplary embodiment. Rather, the numbering of the sealing elements serves merely to distinguish them theoretically. An exemplary embodiment of the pump is therefore possible which has only the first sealing element. An exemplary embodiment of the pump is also possible which has only the second sealing element. However, an exemplary embodiment of the pump is also possible which has both the first and the second sealing element.

The second sealing element is preferably fastened captively to the relief projection in the region of the relief face. Here, as viewed in the axial direction, it protrudes beyond the relief face towards the axial bottom face at least to such an extent that its sealing contact with said axial bottom face is ensured in the second functional position of the cold starting element. In one preferred exemplary embodiment, it is configured in such a way that, as viewed in the radial direction, it is at a sufficient spacing from the wall of the relief receptacle, with the result that no additional friction forces are generated by way of the second sealing element during the stroke of the cold starting element, which additional friction forces might impede a movement of the cold starting element.

An exemplary embodiment of this type can be realized in a particularly suitable manner if the relief projection is of spherical configuration. In this case, an external diameter of the relief projection in the region of the relief face is smaller anyway than the greatest external diameter which interacts with the wall of the relief receptacle. It is therefore readily possible to arrange the second sealing element in the region of the relief face in such a way that it does not come into contact with the wall of the relief receptacle.

As soon as the cold starting element has reached its second functional position, the second sealing element bears sealingly against the axial bottom face. Here, as viewed in the radial direction, the relief bore is arranged within the second sealing element with the result that the region of the relief face radially within the second sealing element after the sealing contact of the latter against the axial bottom face is loaded with the pressure which is lower with regard to the system pressure, as a result of which the cold starting element overall is relieved.

In a reversal of this functional principle, it is also possible that the second sealing element is provided on the axial bottom face. In this case, it is preferably arranged in a groove which is provided in the axial bottom face, in particular an annular groove, the second sealing element preferably being configured as a O-ring. In the second functional position of the cold starting element, the relief face bears sealingly against the second sealing element.

One exemplary embodiment of the pump is also preferred in which a third sealing element is arranged on the relief projection, which third sealing element reaches around the relief projection, as viewed along its circumference. Here, the third sealing element bears sealingly against the wall which reaches around the relief receptacle. The third sealing element is preferably configured as an O-ring. In one preferred exemplary embodiment, the relief projection has a groove in its outer circumferential face, in particular an annular groove, in which the third sealing element is arranged.

The numbering of the sealing element as "third sealing element" also serves merely in this case to distinguish it theoretically from the first and the second sealing element. It is in no way necessarily provided that one exemplary embodiment has all three sealing elements.

Radial sealing of the relief receptacle is achieved by way of the third sealing element, whereas axial sealing is achieved by way of the first and/or the second sealing element. In every functional position of the cold starting element, the third sealing element bears sealingly against the wall of the relief receptacle. A leakage path during the opening stroke of the cold starting element, as long as the latter is not yet arranged in its second functional position, is therefore avoided with the aid of the third sealing element. The relief projection can be of short and compact configuration. However, the sealing element which is arranged in the region of the circumference of the relief projection increases the friction which acts during the stroke with the result that an increased application of force is required for displacing the cold starting element from its first functional position into its second functional position. A short overall design of the relief projection and the relief receptacle has the disadvantage, moreover, that jamming of the cold starting element can occur during the stroke.

One exemplary embodiment of the pump is also preferred in which the relief projection is guided substantially without play in the relief receptacle. In this case, the external diameter of the relief projection and the internal diameter of the wall of the relief bore are manufactured with an accurate fit with respect to one another, which results here in only a small, minimum play. Jamming of the relief projection in the relief receptacle is virtually ruled out as a result of the substantially play-free guidance, a relative movement between the elements still being possible at the same time, however. Accordingly, the wording "substantially play-free" addresses the fact that there is firstly tight guidance with avoidance of jamming and secondly also at the same time displaceability between the elements. In this case, the length of the relief projection and the relief receptacle are preferably selected in such a way that a leakage towards the relief bore on account of the substantially play-free guidance is so low that an additional seal can be dispensed with. In this case, preferably neither the first nor the second nor the third sealing element is therefore required. However, an increased installation space requirement results on account of the axial extension of the relief projection which is necessary for a sufficient sealing action. In addition, a leakage path which is permanent if small remains between the relief projection and the relief receptacle towards the relief bore.

One exemplary embodiment is preferred, in which the relief projection has at least one pressure relief groove which extends in the circumferential direction on a circumferential face. In a manner which is known per se, radial forces in the region of the relief projection are to be avoided by way of a pressure relief groove of this type, because the pressure on all sides around the relief projection can be equalized via the pressure relief groove. The relief projection is therefore centered by way of the at least one pressure relief groove. This is a customary design of pistons which are guided substantially without play, and is known per se, with the result that it is not described in further detail here.

It is nevertheless possible, in one exemplary embodiment, in which the relief projection is guided at least virtually without play in the relief receptacle, to provide an axial seal in the form of the first sealing element and/or in the form of the second sealing element. In this case, the play of the relief projection in the relief receptacle can be increased at least to such an extent that pressure relief grooves are not required for centering the relief projection. The leakage which is increased per se as a result is then reduced by way of the axial seal in the form of the first and/or the second sealing element in the second functional position of the cold starting element.

One exemplary embodiment of the pump is also preferred in which the cold starting element overall is configured as a piston which is guided in regions in the relief receptacle. In an exemplary embodiment of this type, the cold starting element does not have a relief projection, but rather is itself overall configured as a piston with an outer circumferential face which is guided in the relief receptacle. In this way, a particularly short overall design of the cold starting element can be realized, and the relief face is configured to be very large in comparison with the entire face of the cold starting element which faces away from the pressure region. In particular, the relief face comprises virtually the entire face of the cold starting element which faces away from the pressure region. As a result, the cold starting element is pressure-relieved particularly efficiently. In an exemplary embodiment of this type, however, there is an increased installation space requirement in the radial direction because the relief receptacle has to be adapted to the entire circumference of the cold starting element.

It is possible that the cold starting element overall is of spherical configuration in the region of its outer circumference. Jamming during an opening stroke from the first functional position into the second functional position, and also during a closing stroke from the second functional position into the first functional position, is avoided as a result. At the same time, friction forces are reduced.

One exemplary embodiment is also preferred which is distinguished by the fact that a fourth sealing element is arranged on a stop face of the cold starting element, which stop face faces the axial bottom face. This design is preferred if the cold starting element overall is configured as a piston which is guided in regions in the relief receptacle. The cold starting element bears sealingly against the bottom face with the fourth sealing element here in the second functional position.

The fourth sealing element is preferably configured as an O-ring. A groove, in particular an annular groove, is particularly preferably made in the stop face, in which groove the fourth sealing element is arranged.

The designation of the fourth sealing element in the context of numbering also serves in this case merely to distinguish the different sealing elements theoretically. It is in no way necessarily provided that each exemplary embodiment of the pump comprises all the sealing elements.

In the exemplary embodiment of the pump in which the cold starting element overall is configured as a piston which is guided in regions in the relief receptacle, the spring element is preferably arranged in regions in a cut-out of the cold starting element, the spring element being supported on the rear face of the cold starting element, which rear face is part of the relief face here.

DRAWINGS

The drawings described herein are for purposes of illustration only of selected embodiments and not all possible implementations, and the drawings are not intended to limit the scope of the present disclosure.

Figure 2:
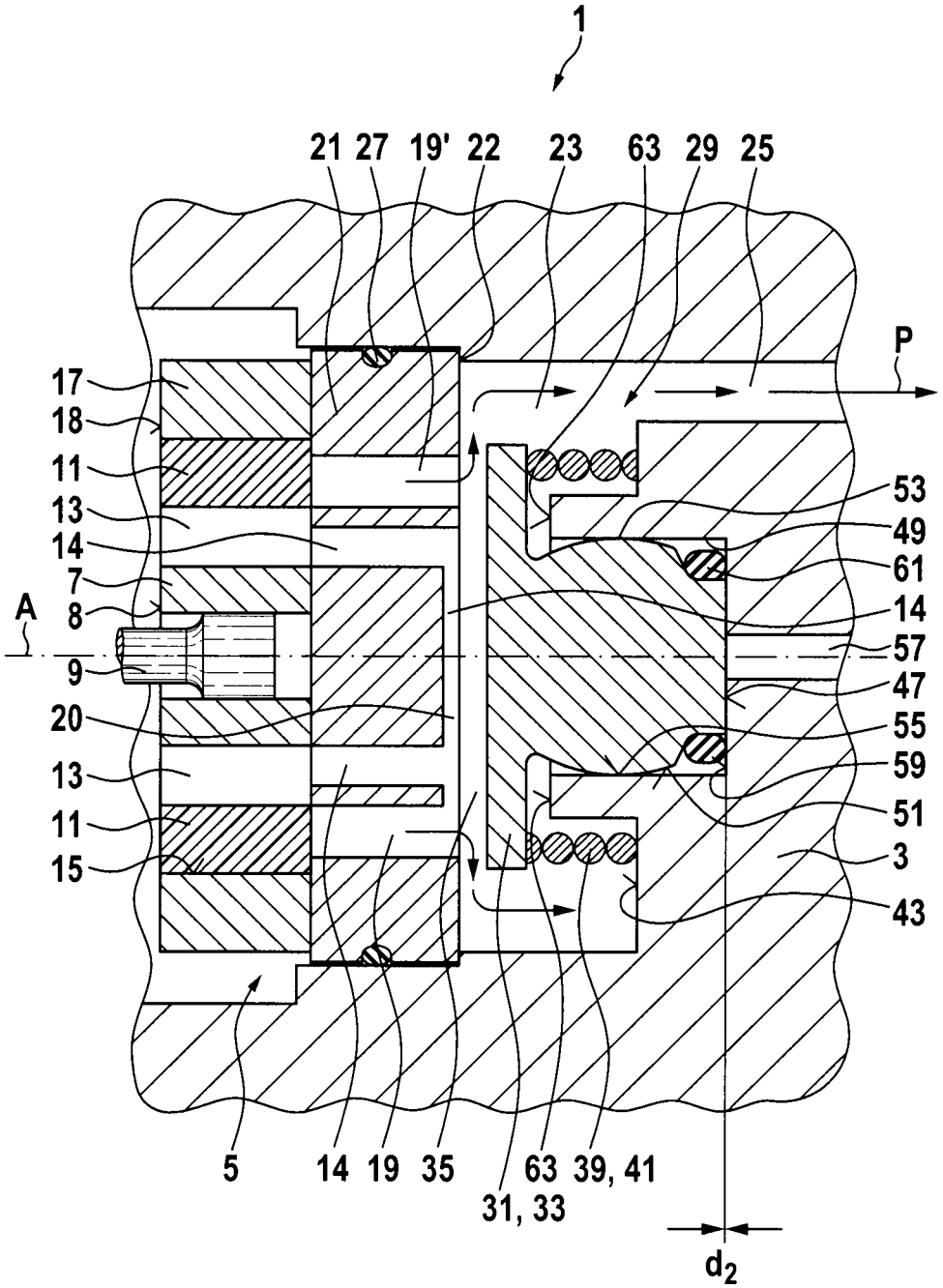
Figure 3:
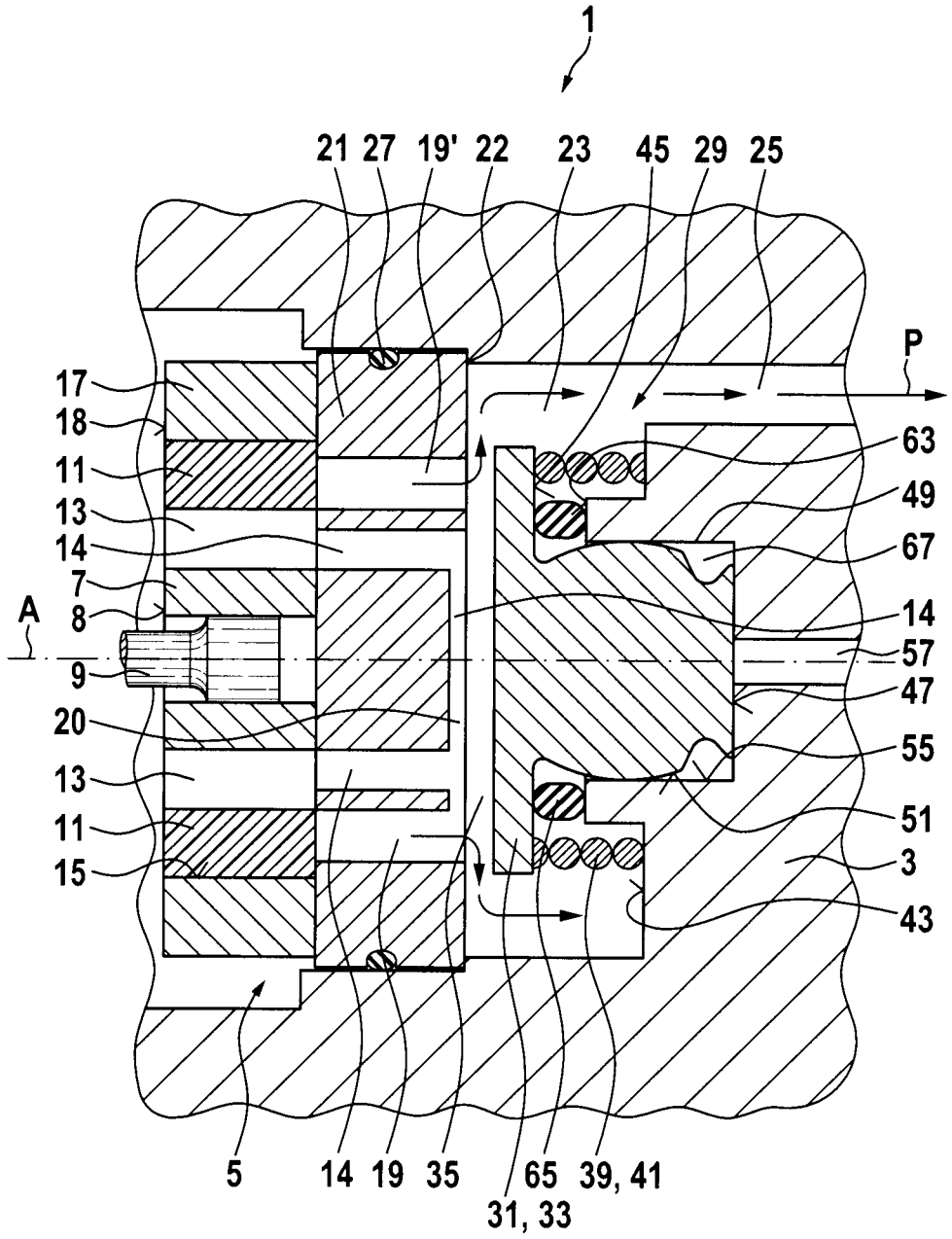
Figure 4:
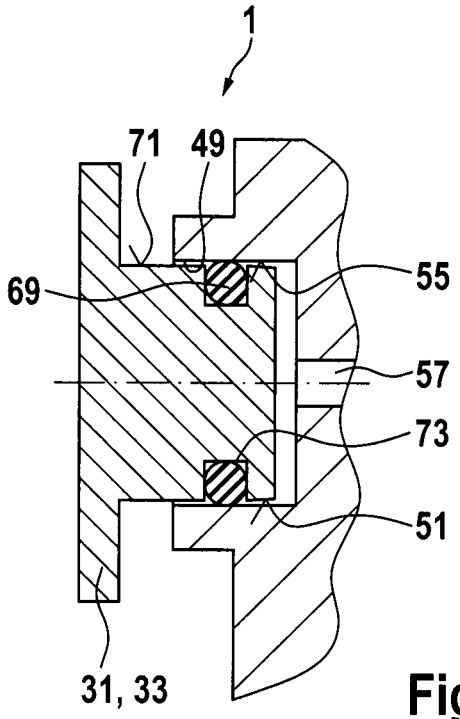
Figure 5:
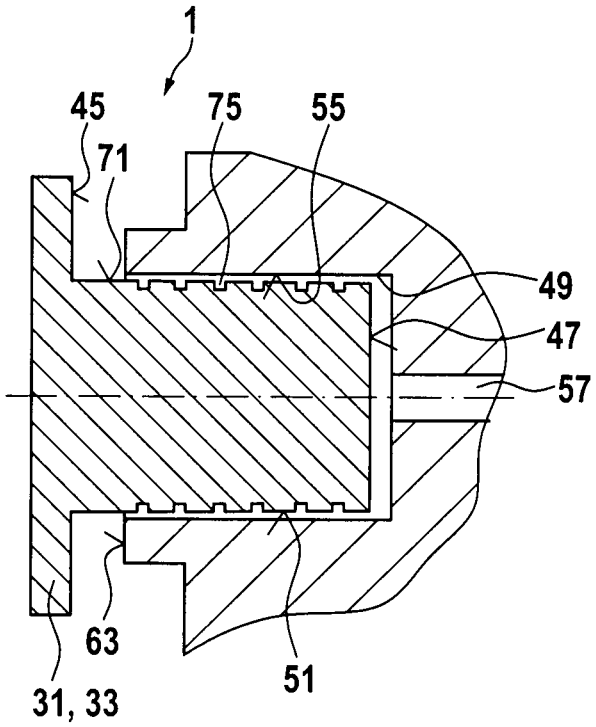
Figure 6:
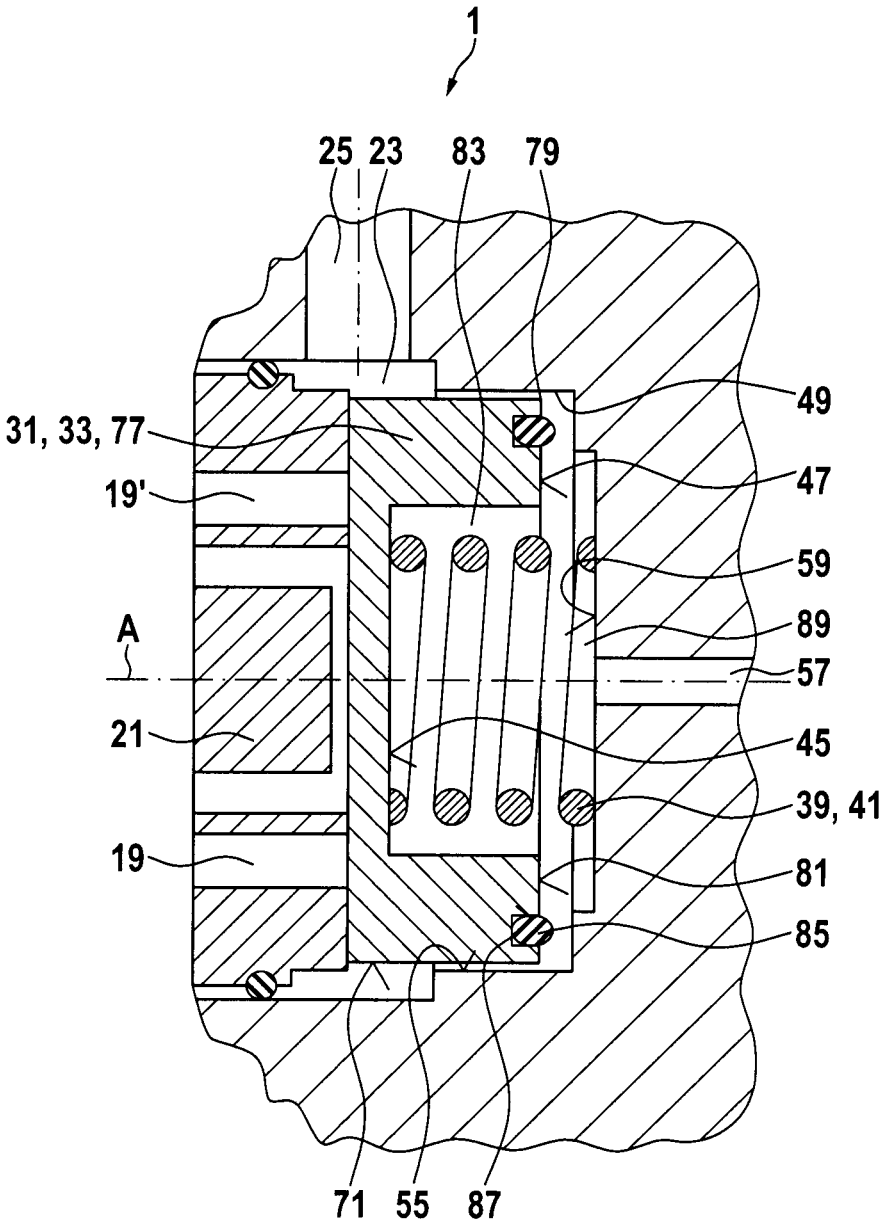

In the following text, the disclosure will be explained in greater detail using the drawings, in which:

FIG. 1 shows a diagrammatic illustration of a first exemplary embodiment of the pump having a cold starting element in the first functional position, FIG. 2 shows a diagrammatic illustration of the first exemplary embodiment of the pump having the cold starting element in the second functional position, FIG. 3 shows a diagrammatic illustration of a second exemplary embodiment of the pump, FIG. 4 shows a diagrammatic detailed illustration of a third exemplary embodiment of the pump, FIG. 5 shows a diagrammatic detailed illustration of a fourth exemplary embodiment of the pump, and FIG. 6 shows a diagrammatic illustration of a fifth exemplary embodiment of the pump.

DETAILED DESCRIPTION

Example embodiments will now be more fully described with reference to the accompanying drawings. However, the following description is merely exemplary in nature and is not intended to limit to present disclosure; its subject matter, applications or uses.

Example embodiments are provided so that this disclosure will be thorough, and will fully convey the scope to those who are skilled in the art. Numerous specific details are set forth such as examples of specific components, devices, and methods, to provide a thorough understanding of embodiments in many different forms and that neither should be construed to limit the scope of the disclosure. In some example embodiments, well-known processes, well-known device structures, and well-known technologies are not described in detail.

FIG. 1 shows a diagrammatic illustration of a part detail of a first exemplary embodiment of a pump 1 which is configured here as a vane cell pump. The pump 1 has a housing 3 in which a pump assembly 5 is received. The pump assembly 5 comprises a rotor 7 which is connected fixedly to a shaft 9 so as to rotate with it, which shaft 9 can be rotated about a rotational axis A. The rotor 7 has radially running receptacles which are configured here as slots and in which delivery elements 11 are received displaceably, as viewed in the radial direction, that is to say perpendicularly with respect to the rotational axis A.

Moreover, the rotor 7 comprises expelling regions 13 radially within the delivery elements 11, that is to say as viewed in the direction towards the rotational axis A, which expelling regions 13 can be loaded with a pump pressure during operation of the pump 1 by way of lower delivery element grooves 14 which are fluidically connected to the expelling regions 13, with the result that the delivery elements 11 are expelled out of the receptacles not only by way of the centrifugal force on account of the rotation of the rotor 7 about the rotational axis A, but also by way of the pressure force which acts on them in the radial direction in the expelling regions 13. Here, the delivery elements 11 are displaced against an inner circumferential face 15 of a contour ring 17. The inner circumferential face 15 is configured in such a way that at least one, preferably two, particularly preferably crescent-shaped delivery spaces are formed. The delivery spaces are passed through by the delivery elements 11*vpm* rotations of rotor 7 and define two pump sections. Each of the two pump sections defines one suction region (shown schematically by phantom-lined circles 16, 16' in FIG. 1) and one pressure region 19, 19' (shown in FIG. 1) being formed. The pressure regions 19, 19' are configured, for example, as pressure kidneys in a pressure plate 21. At least one of the pressure regions 19, 19', in specific terms only the low pressure region 19 here, is fluidically connected at least in regions to the expelling regions 13 via a first fluid path 20 which is formed by way of the lower delivery element grooves 14 with the result that the expelling regions 13 are loaded during operation of the pump 1 at least in regions, in particular dependent on an instantaneous rotary angle of the rotor 7, with the pump pressure which prevails in the pressure region 19.

The rotor 7 and the contour ring 17 bear sealingly on an axial front side 8, 18 thereof against a sealing face (not shown here) of the housing 3. The pressure plate 21 is provided on an opposite side (as viewed in the axial direction) of said two parts, which pressure plate 21 has the pressure regions 19, 19' as recesses, for example as what are known as pressure kidneys, and by way of which pressure plate 21 the fluid which is delivered by the pump 1 is guided during operation of the pump 1 into a pressure space 23 the said pressure space 23 having an outflow region 25 through which the fluid is guided to a consumer. The pressure plate 21 is preferably supported by a housing collar 22 against the contour ring 17 and the rotor 7. The pressure plate 21 is sealed against the housing 3, for example, by way of a radial sealing element 27 which is preferably configured as an O-ring. The lower delivery element grooves 14, which are configured as lower vane groups in the exemplary embodiment of the vane cell pump 1 which is shown, are made in the pressure plate 21. The lower delivery element grooves 14 are fluidically connected firstly to the pressure region 19 and secondly at least in regions to the expelling regions 13.

The pump 1 further includes a cold starting device 29 which comprises a cold starting element 31 which is prestressed into a first functional position shown in FIG. 1 and is configured here as a cold starting plate 33. A second fluid path 35, which is symbolized by way of arrows in FIG. 2 and leads from the pressure regions 19, 19' to the pressure space 23, is shut off in the first functional position (shown in FIG. 1) of the cold starting element 31. At the same time, the first fluid path 20 is also shut off or sealed with respect to the pressure space 23. Here, in the exemplary embodiment shown, the cold starting element 31 or the cold starting plate 33 lies with a sealing face 37 sealingly on the pressure plate 21 with the result that the pressure regions 19, 19' are closed sealingly with respect to the pressure space 23. In the exemplary embodiment shown, in which only one of the pressure regions 19, 19', namely the pressure region 19 here, is fluidically connected to the expelling regions 13, it is sufficient in principle if the cold starting element 31 sealingly closes the one pressure region 19 and at the same time also the first fluid path 20 towards the pressure space 23.

In the exemplary embodiment shown, in its first functional position, the cold starting plate 33 also disconnects a fluidic connection between the two pressure regions 19, 19' completely.

In the exemplary embodiment shown, the cold starting plate 33 is displaced into its first functional position and therefore against the pressure plate 21 by way of a spring element 39 which is configured here as a helical spring 41. The cold starting plate 33 is accordingly prestressed into the first functional position by way of the spring element 39. Here, the helical spring 41 is supported on one side on the housing 3, in particular on a supporting shoulder 43 there, and on the other side on a rear face 45 of the cold starting element 31. Here, the rear face 45 of the cold starting element 31 faces away from the pressure regions 19, 19' and faces the pressure space 23. It extends perpendicularly with respect to the rotational axis A here.

The function of the cold starting device 29 is as follows. When the pump 1 is brought to a standstill, the delivery elements 11 which are arranged at the top in FIG. 1 move as a result of gravity into the receptacles of the rotor 7, and therefore into the expelling regions 13. When the pump becomes colder, the viscosity of fluid which is delivered by the pump 1, for example a hydraulic oil, increases. When the pump 1 is started up again, a short-circuit between the suction region 16' and the top pressure region 19' results in a region which is arranged at the top, in which the delivery elements 11 have retracted into the rotor 7, the delivery elements 11 extending out of the rotor 7 only slowly solely as a result of gravity, because they can be moved only slightly in the viscous, cold fluid. The pump 1 therefore requires a relatively long starting-up time and/or a high rotational speed before it exhibits its full delivery capacity.

This problem is eliminated by way of the cold starting device 29. At the standstill of the pump, the pressure space 23 is pressureless. The cold starting element 31 is displaced against the pressure plate 21 by the spring element 39 and thus seals the pressure regions 19, 19' with respect to the pressure space 23 and preferably also with respect to one another. When the pump 1 then runs up, first of all no fluid is delivered via the pressure regions 19, 19' into the pressure space 23. Rather, all the fluid which is delivered by the lower pressure space 19 passes via the first fluid path 20 into the expelling regions 13, with the result that the delivery elements 11 are expelled by way of the fluid which is delivered by the pump 1 during running up and by way of the pressure which is produced in this way. The pump 1 therefore exhibits its full delivery capacity very rapidly. If the pressure in the pressure regions 19, 19' correspondingly rises above a value, at which the force which acts on the cold starting element 31 counter to the spring force of the spring element 39 is greater than said prestressing force, the cold starting element 31 is displaced to the right (FIG. 1), with the result that it releases the second fluid path 35. The pump 1 then delivers fluid via the pressure regions 19, 19' into the pressure space 23 and via the outflow region 25 further to the consumer (not shown here). Here, a system pressure which depends, inter alia, on the consumer prevails in the pressure space 23. The system pressure also loads the rear face 45 of the cold starting plate 33. The pump pressure which prevails in the pressure regions 19, 19' therefore has to be great enough, in order to hold the cold starting element 31 in the second functional position, and therefore open, permanently during operation of the pump counter to the prestress of the spring element 39 firstly and the system pressure secondly. Accordingly, the pump has an increased power consumption solely by virtue of the fact that the cold starting element 31 has to be held open permanently.

This problem is solved by way of the pump 1 disclosed herein in accordance with the present disclosure. To this end, it is provided that the cold starting element 31 has a relief face 47 which faces away from the pressure regions 19, 19' and by way of which it is arranged in a relief receptacle 49. The relief receptacle 49 is configured as a bore in the housing 3 in the exemplary embodiment which is shown in FIG. 1.

It is shown, moreover, that the cold starting element 31 is formed to include a relief projection 51 on its side which faces away from the pressure regions 19, 19', namely starting from the rear face 45, and on which the relief face 47 is arranged as an axial end face of the relief projection 51. The relief projection 51 extends in the direction of the rotational axis A, starting from the rear face 45, away from the pressure regions 19, 19' into the relief receptacle 49. Here, the relief face 47 is oriented in such a way that the rotational axis A lies perpendicularly on it.

The relief projection 51 preferably has narrow tolerances when disposed in the relief receptacle 49. In the exemplary embodiment which is shown in FIG. 1, it is of spherical configuration, that is to say has a region 53 of greatest diameter which is spaced apart firstly from the rear face 45 and secondly from the relief face 47, in each case as viewed in the axial direction. The spherical design of the region 53 of the relief projection 51 ensures that the relief projection 51 does not jam in the relief receptacle 49 during a stroke of the cold starting element 31, even in the case of slight tilting movements. Otherwise, the relief projection 51 is preferably configured symmetrically with respect to the rotational axis A.

The relief receptacle 49 has a wall 55 which is configured as an inner circumferential wall. The wall 55 is of cylinder-symmetrical configuration and, with regard to its internal diameter, is adapted to the external diameter, in this case to the greatest external diameter of the region 53 of the relief projection 51, in such a way that the relief projection 51 has narrow tolerances in the relief receptacle 49 and, in particular, is guided with or substantially without play, that is to say with minimum play, depending on the exemplary embodiment.

A relief bore 57 opens into the relief receptacle 49. The relief bore 57 is fluidically connected in a manner which is not shown here to a surrounding region of the pump 1 or to a reservoir for fluid which is delivered by the pump 1. The relief receptacle 49 is therefore pressure-relieved by the relief bore 57 and always has the ambient pressure or reservoir pressure which is lower in comparison with the system pressure during operation of the pump 1.

Moreover, the relief receptacle 49 has an axial bottom face 59 into which the relief bore 57 opens. In this case, the axial bottom face 59 extends here perpendicularly with respect to the rotational axis A. The axial bottom face 59 is oriented parallel to the relief face 47. Here, in the first functional position of the cold starting element 31 which is shown in FIG. 1, the relief face 47 is arranged at a first spacing $d_1$ displaced from the axial bottom face 59.

The relief face 47 which is arranged on the end of the relief projection 51 is surrounded by a second sealing element 61. The sealing element 61 is preferably configured as an O-ring or as a shaped seal. One exemplary embodiment of the pump 1 is also possible, in which the sealing element 61 is not provided, the exemplary embodiment otherwise being configured as shown in FIG. 1. The sealing element 61 serves, when bearing against the axial bottom face 59, to stop a leakage flow between the relief projection 51 and the wall 55 towards the relief bore 57. If a leakage of this type which is possibly present is accepted or is minimized by way of corresponding tolerances of the components, it is possible to dispense with the sealing element 61.

The sealing element 61 is preferably fastened captively to the relief projection 51 in the region of the relief face 47. It is configured here in such a way that it is at a sufficient radial spacing from the wall 55, in order not to generate any additional friction forces in the region of the wall 55 during an opening stroke or a closing stroke of the cold starting element 31. At the same time, the sealing element 61 protrudes beyond the relief face 47, as viewed in the axial direction, towards the axial bottom face 59, with the result that its resilient, elastic and sealing contact with the axial bottom face 59 is possible.

FIG. 2 shows the exemplary embodiment of the pump 1 according to FIG. 1 in the second functional position of the cold starting element 31. Identical and functionally identical elements are provided with identical reference numerals, with the result that reference is made to this extent to the preceding description. On account of the pump pressure which prevails in the pump spaces 19, 19' during operation of the pump 1, the cold starting element 31 is displaced counter to the prestressing force of the spring element 39 into the second functional position. Here, the second fluid path 35 is released with the result that the fluid which is delivered by the pump 1 is delivered by way of the pressure regions 19, 19' into the pressure space 23 and via the outflow region 25 (as indicated by an arrow P) to a consumer (not shown).

In the second functional position, the relief face 47 is arranged at a second spacing $d_2$ from the bottom face 59, the second spacing $d_2$ being equal to or approximately zero in the exemplary embodiment which is shown, with the result that the relief face 47 substantially bears against the axial bottom face 59 here (apart from the spacing which is defined by way of the compressed sealing element 61). The second sealing element 61 which protrudes somewhat beyond the relief face 47 is namely compressed, the second sealing element 61 bearing sealingly against the axial bottom face 59. Leaks which possibly exist between the relief projection 51 and the wall 55 are sealed in this way, with the result that no fluid can escape from the pressure space 23 through the relief bore 57. As has already been described, it is possible in the case of corresponding tolerances of the components and/or an acceptance of a low leakage to dispense with the second sealing element 61. An exemplary embodiment of this type of the pump 1 is then particularly inexpensive.

It is shown that, in its second functional position, the cold starting element 31 is arranged at least in regions with the relief face 47 which faces away from the pressure region 19, 19' in the relief receptacle 49 in such a way that the relief face 47 is loaded during operation of the pump 1 with a pressure which is smaller than the system pressure in the outflow region 25.

The region which is arranged radially inside the second sealing element 61, in particular the relief face 47, is namely pressure-relieved by way of the relief bore 57 with the result that the system pressure does not load the cold starting element 31 here, but rather the lower pressure in the relief bore 57, preferably the ambient pressure or the pressure in a reservoir for the fluid which is delivered by the pump 1. As a result, the forces which are required to hold the cold starting element 31 open are reduced in the region of the pressure regions 19, 19', with the result that the difference between the pump pressure in these regions and the system pressure in the pressure space 23 or in the outflow region 25 is reduced. The power consumption of the pump 1 is reduced as a result.

During the opening stroke of the cold starting plate 33, a small leakage path to the relief bore 57 results at any rate until the second sealing element 61 bears sealingly against the axial bottom face 59. The temporary, brief leakage is comparatively small, however, and can be accepted readily.

It is also shown that the prestressing force of the spring element 39 is preferably adapted to the specific requirements of the pump 1, in particular to the lowermost pressure level which is necessary to expel the delivery elements 11. Via the prestress of the spring element 39, the opening pressure of the cold starting element 31 is namely fixed, and therefore the lowest pump-internal pressure at which the pump 1 delivers fluid.

The exemplary embodiment according to FIGS. 1 and 2 has a compact overall design which is short, in particular, as measured in the axial direction, and the jamming of the relief projection 51 in the relief receptacle 49 during the opening stroke and/or during a closing stroke in the case of possible tilting movements and/or axial angular errors between the cold starting element 31 and the relief receptacle 49 is not possible as a result of the spherical shape of the relief projection 51.

FIG. 3 shows a diagrammatic illustration of a second exemplary embodiment of the pump 1. Identical and functionally identical elements are provided with identical reference numerals, with the result that reference is made to the preceding description to this extent. The exemplary embodiment according to FIG. 3 differs from the first exemplary embodiment according to FIGS. 1 and 2 merely in so far as the relief receptacle 49 is sealed differently in the second functional position of the cold starting element 31. In the following text, merely the differences between the exemplary embodiments will be described.

In the second exemplary embodiment which is shown in FIG. 3, the relief receptacle 49 comprises an end face 63 which is configured as an annular face and reaches around the relief receptacle 49 on the wall 55. The end face 63 is also provided per se in the first exemplary embodiment according to FIGS. 1 and 2 and is labelled correspondingly there. In a difference from the first exemplary embodiment, however, the second exemplary embodiment according to FIG. 3 has a first sealing element 65 which is arranged on the end face 63. A groove, in particular an annular groove, is preferably provided in the end face 63, in which groove the first sealing element 65 which is preferably configured as an O-ring is received in regions. The cold starting element 31 (the cold starting plate 33 here) bears sealingly with the rear face 45 on the first sealing element 63 in the second functional position. In this way, an interior 67 of the relief receptacle 49 is sealed with respect to the pressure space 23 and the outflow region 25. The entire interior 67 of the relief receptacle 49 is therefore pressure-relieved via the relief bore 57 in the second exemplary embodiment.

Otherwise, the same advantages which have already been explained in conjunction with the first exemplary embodiment and FIGS. 1 and 2 are realized with regard to the second exemplary embodiment according to FIG. 3. In particular, the exemplary embodiment according to FIG. 3 also has a compact overall design which is short as viewed in the axial direction. Jamming of the cold starting element 31 during the opening stroke and/or during the closing stroke is avoided effectively by way of the spherical design of the relief projection 51.

FIG. 4 shows a diagrammatic detailed illustration of a third exemplary embodiment of the pump 1. Identical and functionally identical elements are provided with identical reference numerals, with the result that reference is made to this extent to the preceding description. Even in conjunction with FIG. 4, merely the differences from the previously described exemplary embodiments are explained, with the result that reference is otherwise made to the preceding description.

In the third exemplary embodiment, a third sealing element 69 which extends around the relief projection 51 along its circumference is arranged on the relief projection 51. Here, the third sealing element 69 bears sealingly against the wall 55 which reaches around the relief receptacle 49. In this exemplary embodiment, this applies to each functional position of the cold starting element 31 (specifically, the cold starting plate 33 here). In this way, an additional leakage path between the relief projection 51 and the wall 55 towards the relief bore 57 is always avoided independently of the instantaneous functional position of the cold starting element 31, with the result that a leakage flow via the relief bore 57 does not occur at any time. At the same time, however, friction between the relief projection 51 and the wall 55 is increased by way of the third sealing element 69 which bears sealingly against the wall 55, with the result that a slightly increased pump pressure in comparison with the previously described exemplary embodiments is required, in order to displace the cold starting element 31 from its first into its second functional position. However, this can also be compensated for by way of the use of a spring element 39 (not shown in FIG. 4) which is adapted correspondingly with regard to its prestressing force. Here, however, the spring element 39 also has to have a sufficient prestressing force in order to displace the cold starting element 31 in the pressureless state counter to friction forces back into its first functional position.

In the third exemplary embodiment, it is preferably provided that the relief projection 51 is of cylindrical configuration, in particular is configured as a circular cylinder, with the relief projection 51 having an outer circumferential face 71. The relief receptacle 49 is preferably likewise of cylindrical, in particular circularly cylindrical, configuration, the wall 55 defining an inner circular cylinder in which the relief projection 51 which is configured as an outer circular cylinder is guided. A circumferential (as viewed in the circumferential direction) annular groove 73 is preferably made in the outer circumferential face 71, in which annular groove 73 the third sealing element 69 which is preferably configured as an O-ring is arranged.

The third exemplary embodiment according to FIG. 4 also requires only a very small installation space, in particular in the axial direction. It is therefore of very compact configuration.

FIG. 5 shows a diagrammatic detailed illustration of a fourth exemplary embodiment of the pump 1. Identical and functionally identical elements are provided with identical reference numerals, with the result that reference is made to this extent to the preceding description. Even in conjunction with FIG. 5, merely the differences from the preceding exemplary embodiments will be explained in the following text, with the result that reference is made otherwise to the preceding description.

In the exemplary embodiment according to FIG. 5, the relief projection 51 is guided substantially without play, that is to say without jamming, in the relief receptacle 49. In this case, the tight radial spacing between the relief projection 51 and the wall 55 results in reliable guidance with the result that tipping and/or tilting of the cold starting element 31 (the cold starting plate 33, in particular, here) is avoided effectively. At the same time, it is possible to dispense with a seal if the relief projection 51 firstly and the wall 55 secondly are configured to be long enough (as viewed in the axial direction) such that there is a hydraulic resistance on account of the tight radial spacing between the relief projection 51 and the wall 55 over the entire contact length between said elements, which hydraulic resistance is great enough that a possibly remaining leakage to the relief bore 57 can be accepted, or is even negligibly small.

In order, in the case of narrow tolerances of this type of the relief projection 51 and the wall 55, to avoid, however, that radial forces act on the relief projection 51, in particular, as a result of pressure differences on different sides of said relief projection 51, the relief projection 51 has at least one pressure relief groove, preferably a multiplicity of pressure relief grooves, on its outer circumferential face 71 here, of which pressure relief grooves only one is labelled with the reference 75 here for the sake of improved clarity. The pressure relief groove 75 is configured as an annular groove which extends along the outer circumferential face 71, as viewed in the circumferential direction. A varying pressure (as viewed in the circumferential direction) is thus compensated for via an equalization flow through the pressure relief groove 75 with the result that the relief projection 51 is free from radial forces, the relief projection 51 being centered by way of the pressure relief groove 75.

The relief projection 51 is preferably likewise of cylindrical, in particular circularly cylindrical configuration here. The relief receptacle 49 is likewise preferably of cylindrical, in particular circularly cylindrical, configuration.

One exemplary embodiment is possible which is modified in comparison with the fourth exemplary embodiment according to FIG. 5 to the extent that the first sealing element 65 is provided here on the end face 63. In this case, at least in the second functional position of the cold starting element 31, a leak towards the relief bore 57 is avoided by way of the sealing contact of the rear face 45 on the first sealing element 65. A play between the relief projection 51 and the wall 55 can therefore be enlarged in this exemplary embodiment, at least to such an extent that the pressure relief grooves 75 can be dispensed with.

As an alternative, it is also possible to provide the second sealing element 61 in the region of the relief face 47 or the axial bottom face 59.

FIG. 6 shows a diagrammatic detailed illustration of a fifth exemplary embodiment of the pump 1. Identical and functionally identical elements are provided with identical reference numerals, with the result that reference is made to this extent to the preceding description. Even in relation to FIG. 6, merely the differences from the preceding exemplary embodiments will be explained, with the result that otherwise reference is made to their description.

In the fifth exemplary embodiment which is shown in FIG. 6, the cold starting element 31, which is also configured here as a cold starting plate 33, is configured overall as a piston 77 which is guided in regions in the relief receptacle 49. This has the advantage that a very large proportion of an axial end face 79 of the cold starting element 31, which axial end face 79 faces away from the pressure regions 19, 19', is pressure-relieved in the second functional position. Here, the relief face 47 namely comprises firstly a stop face 81 which faces the bottom face 59 and is preferably annular, and also the rear face 45 which is then arranged in a cut-out 83 of the cold starting element 31. The relief face 47 is therefore of stepped configuration, the stop face 81 and the rear face 45 being arranged offset with respect to one another, as viewed in the axial direction. The spring element 39 which is configured as a helical spring 41 is arranged in the cut-out 83 which is produced in this way. Here, the spring element 39 is to this extent also arranged in the relief receptacle 49 and is supported on one side on the rear face 45 and on the other side on the axial bottom face 59.

A fourth sealing element 85 is preferably arranged on the stop face 81, the cold starting element 31 bearing sealingly against the axial bottom face 59 in its second functional position with the fourth sealing element 85 which is preferably configured as an O-ring. It is preferably provided here that a groove, in particular an annular groove 87, is made in the stop face 81, in which groove the fourth sealing element 85 is arranged.

A cut-out 89, into which the relief bore 57 opens, is preferably made in the axial bottom face 59. The cut-out 89 preferably extends (as viewed in the radial direction) as far as the fourth sealing element 85 or is configured with regard to its extent in such a way that it corresponds completely to the relief face 47 including the rear face 45 and the stop face 81 which is arranged radially within the fourth sealing element. In this way, the entire relief face 47 is pressure-relieved particularly efficiently because the complete region radially within the fourth sealing element 85 is pressure-relieved via the cut-out 89 and the relief bore 57 even in the second functional position when said fourth sealing element 85 bears sealingly against the axial bottom face 59.

The piston 77 is preferably of cylinder-symmetrical, in particular circularly cylindrical, configuration. In this case, it has a cylindrical, outer circumferential face 71. The relief receptacle 49 is also preferably of cylindrical, in particular circularly cylindrical, configuration.

One exemplary embodiment is possible, in which the outer circumferential face 71 (as viewed in cross section) is configured to be circularly symmetrical but (as viewed in the axial direction) spherical at least in the region which interacts with the wall 55. As a result, jamming of the cold starting element 31 or the cold starting plate 33 which is configured as a piston 77 as a result of tipping and/or tilting during its stroke can be avoided effectively.

The fifth exemplary embodiment which is shown in FIG. 6 has a particularly short overall design (as viewed in the axial direction) and is therefore of compact configuration. A further advantage consists in that, as has already been explained, a larger relief face 47 is formed with the result that there is particularly efficient pressure relief.

As viewed in the radial direction, however, the piston 77 has a greater extent than the relief projection 51 in the previously described exemplary embodiments. Therefore, in the exemplary embodiment shown in FIG. 6, the outflow region 25 of the pressure space 23 is preferably arranged obliquely, with preference perpendicularly with respect to the rotational axis A, whereas it is preferably arranged substantially parallel to the rotational axis A in the previously described exemplary embodiments.

It is shown overall that the pump 1 exhibits both a favourable cold starting behaviour and a reduced power consumption during operation.

While specific aspects have been described in the specification and illustrated in the drawings, it will be understood by those skilled in the art that various changes can be made and equivalence can be substituted for elements thereof without departing from the scope of the present teachings, as defined in the claims. Furthermore, the mixing and matching of features, elements and/or functions between various aspects of the present teachings is expressly contemplated herein so that one skilled in the art will appreciate from the present teachings that features, elements, components, modules and/or functions of one aspect of the present teachings can be incorporated into another aspect as appropriate unless described otherwise above. Moreover, many modifications can be made to adapt a particular situation, configuration or material to the present teachings without departing from the essential scope thereof. Therefore, it can be intended that the present teachings not be limited to the particular aspects illustrated by the drawings and described in the specification as the best mode presently contemplated for carrying out the present teachings but that the scope of the present teachings will include many aspects and examples following within the foregoing description and the appended claims.

LIST OF REFERENCE NUMERALS

1 Pump
3 Housing
5 Pump assembly
7 Rotor
8 Front side
9 Shaft
11 Delivery element
13 Expelling region
14 Lower delivery element groove
15 Inner circumferential face
17 Contour ring
18 Front side
19 Pressure region
20 First fluid path
21 Pressure plate
22 Housing collar
23 Pressure space
25 Outflow region
27 Radial sealing element
29 Cold starting device
31 Cold starting element
33 Cold starting plate
35 Second fluid path
37 Sealing face
39 Spring element
41 Helical spring
43 Supporting shoulder
45 Rear face
47 Relief face
49 Relief receptacle
51 Relief projection
53 Region
55 Wall
57 Relief bore
59 Axial bottom face
61 Second sealing element
63 End face
65 First sealing element
67 Interior
69 Third sealing element
71 Circumferential face
73 Annular groove
75 Pressure relief groove
77 Piston
79 End face
81 Stop face
83 Cut-out
85 Fourth sealing element
87 Annular groove
89 Cut-out
A Rotational axis
19' Pressure region
$d_1$ First spacing
$d_2$ Second spacing
P Arrow

What is claimed:

1. A pump comprising:

at least one suction region and at least one pressure region;

a pressure space which has an outflow region to a consumer;

a rotor which is operatively connected to a shaft which rotates about a rotational axis, in which rotor delivery elements are received displaceably, as viewed in the radial direction;

the rotor having expelling regions radially within the delivery elements, which expelling regions are connected at least partially to the pressure region way of a first fluid path; and a cold starting device which comprises a cold starting element which is prestressed into a first functional position and, in its first functional position, shuts off a second fluid path from the pressure region to the pressure space, the cold starting element opening the second fluid path in a second functional position, the cold starting element being configured and arranged in such a way that it is displaced counter to the prestress into its second functional position by way of a pump pressure which is generated in the pressure region during operation of the pump;

wherein the cold starting element is arranged in its second functional position at least in regions with a relief face which faces away from the pressure region in a relief receptacle in such a way that the relief face is loaded during operation of the pump with a pressure which is smaller than a system pressure in the outflow region.

2. A pump according to claim 1, wherein the cold starting element is configured as a cold starting plate, and wherein the cold starting plate is prestressed into its first functional position by way of a spring element.

3. A pump according to claim 1, wherein the relief receptacle is configured as a bore formed in a housing of the pump.

4. A pump according to claim 1, wherein a relief bore opens into the relief receptacle, and wherein the relief bore is fluidically connected to a surrounding area of the pump or to a reservoir for a fluid which is delivered by the pump.

5. A pump according to claim 4, wherein the relief receptacle has an axial bottom face, the relief bore opening into the axial bottom face, and the relief face being arranged in the first functional position at a first spacing and in the second functional position at a second spacing from the axial bottom face, the second spacing being smaller than the first spacing.

6. A pump according to claim 1, wherein an end face is formed on a wall which reaches around the relief receptacle and wherein a sealing element is arranged on the end face and against which a rear face of the cold starting element bears sealingly in the second functional position.

7. A pump according to claim 1, wherein, on its side which faces away from the pressure region, the cold starting element has a relief projection on which the relief face is arranged, and wherein the relief projection is guided displaceably in the relief receptacle.

8. A pump according to claim 7, wherein the relief projection is guided with play in the relief receptacle.

9. A pump according to claim 7, wherein the relief projection is of spherical configuration.

10. A pump according to claim 7, wherein the relief face which is arranged on the relief projection is surrounded by a sealing element, by way of which the relief projection bears sealingly against the axial bottom face in the second functional position.

11. A pump according to claim 7, wherein a sealing element is arranged on the relief projection, wherein the sealing element reaches around the relief projection, as viewed along its circumference, and wherein the sealing element bears sealingly against a wall which reaches around the relief receptacle.

12. A pump according to claim 7, wherein the relief projection is guided without play in the relief receptacle.

13. A pump according to claim 7, wherein the relief projection has at least one pressure relief groove which extends in a circumferential direction.

14. A pump according to claim 1, wherein the cold starting element is configured as a piston which is guided in the relief receptacle.

15. A pump according to claim 14, wherein a sealing element is arranged on a stop face of the cold starting element, which stop face faces the axial bottom face, the cold starting element bearing sealingly with the sealing element against the axial bottom face in its second functional position.

16. A pump comprising:

a suction region, a pressure region, and a pressure space having an outflow region adapted to be fluidically connected to a consumer;

a rotor supported for rotation about a rotational axis and having a plurality of radially extending receptacles and expelling regions fluidically connecting the receptacles to the pressure region by a first fluid path;

a plurality of rotor delivery elements each disposed in a corresponding one of the receptacles for sliding displacement therein; and a cold starting device having a cold starting element moveable between first and second functional positions and a biasing element normally biasing the cold starting element toward the first functional position, the cold starting element being configured to close a second fluid path between the pressure region and the pressure space when located in its first functional position and to open the second fluid path when located in its second functional position, the cold starting element being displaced from its first functional position to its second functional position in opposition to the biasing exerted thereon by the biasing element in response to a pump pressure generated in the pump region during operation of the pump;

wherein the cold starting element includes a relief projection disposed within a relief receptacle and having a relief face which faces away from the pressure region, and wherein the cold starting element is operable in its second functional position to load the relief face during operation of the pump with a pressure that is smaller than a system pressure in the outflow region.

17. The pump of claim 16 wherein a relief bore opens into a bottom face of the relief receptacle and is fluidically connected to a surrounding area of the pump or to a reservoir for fluid delivered to the pump, wherein the relief face of the relief projection is located at a first distance from the bottom face of the relief receptacle when the cold starting element is in its first functional position and is located at a second distance from the bottom face when the cold starting element is in its second functional position, and wherein the second distance is smaller than the first distance.

18. The pump of claim 17 further comprising a sealing element arranged to provide a sealed interface between a higher pressure fluid in the pressure space and a lower pressure fluid in the relief bore when the cold start element is located in its second functional position.

19. A pump comprising:

a suction region and a pressure region;

a pressure space having an outflow region, a rotor driven by a shaft about a rotational axis and having rotor delivery elements displaceably retained in radially extending rotor receptacles, the rotor having expelling regions radially within the rotor delivery elements and which fluidically connect the rotor receptacles to the pressure region via a first fluid path; and a cold starting element normally biased toward a first functional position for closing a second fluid path from the pressure region to the pressure space, the cold starting element being moveable to a second functional position counter to the biasing based on a pump pressure generated in the pressure region during operation of the pump, the cold starting element having a relief face surface located in a relief receptacle and arranged to face away from the pressure region such that the relief face surface is loaded during operation of the pump with a pressure that is less than a system pressure within the outflow region.

20. The pump of claim 19 wherein a relief bore opens into a bottom face of the relief receptacle and is fluidically connected to a surrounding area of the pump or to a reservoir for fluid delivered to the pump, wherein the relief face of the relief projection is located at a first distance from the bottom face of the relief receptacle when the cold start element is in its first functional position and is located at second distance from the bottom face when the cold start element is in its second functional position, and wherein the second distance is smaller than the first distance.

* * * * *